US007594330B2

(12) United States Patent
Momjian

(10) Patent No.: US 7,594,330 B2
(45) Date of Patent: Sep. 29, 2009

(54) ROSARY AND METHOD FOR MAKING SAME

(75) Inventor: Hagop Momjian, Jerusalem (IL)

(73) Assignee: The Jerusalem Jewelry Mfg. Co., Ltd., Jerusalem (IL)

( * ) Notice: Subject to any disclaimer, the term of this patent is extended or adjusted under 35 U.S.C. 154(b) by 678 days.

(21) Appl. No.: 11/150,422

(22) Filed: Jun. 9, 2005

(65) Prior Publication Data

US 2006/0277757 A1 Dec. 14, 2006

(51) Int. Cl.

| | |
|---|---|
| ***A44C 27/00*** | (2006.01) |
| ***A44C 5/02*** | (2006.01) |
| ***B21L 11/12*** | (2006.01) |
| ***B21L 5/02*** | (2006.01) |
| ***B21L 3/04*** | (2006.01) |

(52) U.S. Cl. ..... 29/896.4; 29/896.41; 29/896.411; 29/896.43; 59/2; 59/3; 59/82; 63/4; 72/453.07

(58) Field of Classification Search ..... 29/896.4, 29/896.41, 896.411, 896.43; 59/2, 3, 30, 59/82; 63/4; 72/453.07

See application file for complete search history.

(56) References Cited

U.S. PATENT DOCUMENTS

| | | | | |
|---|---|---|---|---|
| 2,069,980 | A * | 2/1937 | Stahl | 59/35.1 |
| 2,893,199 | A * | 7/1959 | Sheehan | 59/30 |
| 3,382,589 | A * | 5/1968 | Dowling | 434/246 |
| 7,310,934 | B1 * | 12/2007 | Jensen et al. | 59/35.1 |

* cited by examiner

*Primary Examiner*—David P Bryant
*Assistant Examiner*—Alexander P Taousakis
(74) *Attorney, Agent, or Firm*—Jeffer Mangels Butler & Marmaro LLP

(57) ABSTRACT

Disclosed herein is a method for making an item of jewelry. The method includes the steps of providing a chain comprising a plurality of links; providing at least one bead having an opening defined therethrough; providing a press having a support member, a hammer, and at least one pin; positioning the bead on the chain; resting the bead on the support member; positioning a first link on the at least one pin; and actuating the press, whereby the first link is widened. In a preferred embodiment the item of jewelry is a rosary.

13 Claims, 4 Drawing Sheets

ROSARY AND METHOD FOR MAKING SAME

FIELD OF THE INVENTION

This invention relates to a method for making a rosary, and, in particular embodiments, a method for making a rosary using a press.

BACKGROUND OF THE INVENTION

Rosaries have been made for centuries and many methods have been used for manufacturing them. For example, the traditional or "tying" method comprises inserting a wire through a bead and making a "pig-tail" like loop on both ends of the bead, to hold the bead in place. Then another wire is inserted into the loop and another similar loop is made. The loops have two functions; first to connect a first bead to the next one, and secondly to hold the bead in place. This operation is repeated for all of the beads throughout the making of the rosary. However, problems with this method exist. Sometimes, a sharp point on the end of the wire can be created when cutting the wire to make the loop. This point can scratch or even cut the wearer/user of the rosary. Also, because this type of rosary is "hand made" the process is not always exactly the same and the rosary can look crooked since the beads are not always perfectly aligned. Also, by pulling this type of rosary the rosary can be easily broken.

In another method, commonly referred to as the hooking method, a wire is inserted into each bead and bent into a loop shape at both ends. This step is repeated until the rosary is complete. However, the greatest disadvantage with this method is that if the user pulls on the rosary the loops can come apart which may result in the beads falling off of the wire.

In another method known as the soldering method, a long chain is passed through the openings in the beads, the beads are spaced apart from one another as desired and are then soldered into position. The problems with this method are that the soldering material can ooze out of the beads and form an ugly and uneven surface on the bead, and the soldering may weaken the chain and result in breakage. The oozing of the solder out of the beads also can cause stiffening of the chain around the bead, thus making the chain prone to bending around the beads. Lastly, this method cannot be used with some materials, such as Mother of Pearl or Olive wood.

Accordingly, a need exists for a method for making a rosary that overcomes the disadvantages described above.

SUMMARY OF THE PREFERRED EMBODIMENTS

In accordance with a first aspect of the present invention there is provided a method for making an item of jewelry. The method includes the steps of providing a chain comprising a plurality of links; providing at least one bead having an opening defined therethrough; providing a press having a support member, a hammer, and at least one pin; positioning the bead on the chain; resting the bead on the support member; positioning a first link on the at least one pin; and actuating the press, whereby the first link is widened. In a preferred embodiment the press includes at least two pins positioned on opposite sides of the support member, and the method comprises the additional steps of positioning a second link on the second pin and widening the second link.

In accordance with another aspect of the present invention there is provided a method of making an item of jewelry. The method includes the steps of providing a chain comprising at least first, second and third links each having a first width; providing at least one bead having an opening defined therethrough; positioning the bead on the chain by inserting the chain through the opening in the bead such that at least a portion of the second bead is positioned within the opening and the first and third links are positioned on opposite sides of the bead; and widening the first and third links to a second width. The diameter of the opening has a greater dimension than the first width and a lesser dimension than the second width.

In accordance with another aspect of the present invention there is provided a rosary that includes a chain comprising at least first, second and third links and at least one bead having an opening defined therethrough. The second link defines a first width and the first and third links define a second width. The second link is positioned at least partially within the opening, and the diameter of the opening has a greater dimension than the first width and a lesser dimension than the second width.

In accordance with yet another aspect of the present invention there is provided a press for making jewelry that includes a support member, a hammer positioned above the support member and first and second pins positioned on opposite sides of the support member. The hammer is adapted to move downwardly and press against an object supported on the support member. In a preferred embodiment the support member has a concave upper surface and is biased upwardly by a spring, and the hammer includes an elastomeric head thereon.

Other features and advantages of the invention will become apparent from the following detailed description, taken in conjunction with the accompanying drawings which illustrate, by way of example, various features of embodiments of the invention.

BRIEF DESCRIPTION OF THE DRAWINGS

The detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
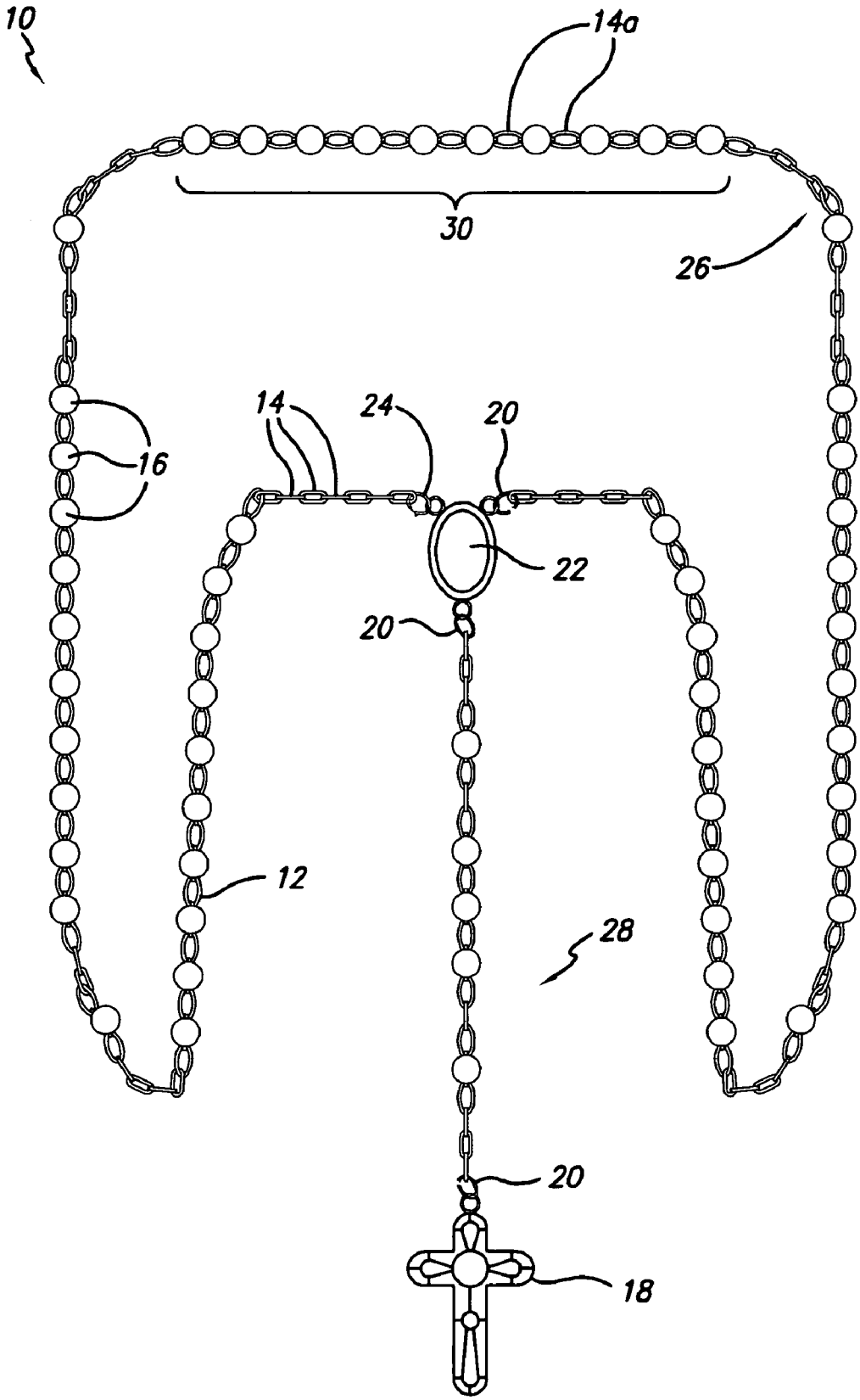
FIG. 1 is a side elevational view of a rosary according to an embodiment of the present invention.

As shown in the drawings for purposes of illustration, the invention is embodied in a cold pressing method for making a necklace or other piece of jewelry. In the preferred embodiment of the present invention the piece of jewelry is a rosary 10. However, this is not a limitation on the present invention. It will be understood that the process can be used to make any number of different types of jewelry including necklaces, bracelets, anklets, belly chains, etc. Other uses for the method described herein will be readily apparent to those skilled in the relevant art.

With reference to FIGS. 1-7, generally, the rosary 10 includes a chain 12, comprised of a plurality of links 14, and a plurality of beads 16. In a preferred embodiment the chain 12 (and the links 14 thereof) is made of a metal. In one embodiment, the chain 12 can be diamond cut to give the chain 12 extra shine.

As is generally known in the art the rosary 10 also includes a cross 18 or crucifix that is preferably affixed to the chain using a jump ring 20 or the like. Also, the rosary 10 includes a center 22 and a clasp 24 for allowing a portion of the chain 12 to be arranged in a loop 26 with another portion of the chain 12 extending outwardly therefrom (referred to herein as a leg 28) so that the user can wear the rosary 10 around their neck. It will be understood that the inclusion of cross 18, jump rings 20, center 22, clasp 24, loop 26 and leg 28 are well known in the rosary art. Accordingly, the assembly of these elements of the rosary will not be described herein. The assembly of the chain 12 (with the links 14 and beads 16) will be described herein.

It will be appreciated by those skilled in the art that the beads, links and other elements of a rosary can be arranged differently according to a specific user's desire. Accordingly, a chain 12 may, for example, comprise ten beads 16, or any other number of beads 16 depending on the intended use, i.e., the desired prayers. Those skilled in the art will appreciate, however, that the beads 16 may have any other configuration. Each of the beads 16 may represent a particular prayer. Further, a bead 16 or set of beads 30 may represent a particular set of prayers. The leg 28, also known in the art as the "small chain" may, for example, comprise three beads. Again, those skilled in the art will appreciate, however, that the beads 16 on the leg 28 may also have any other configuration.

Figure 2:
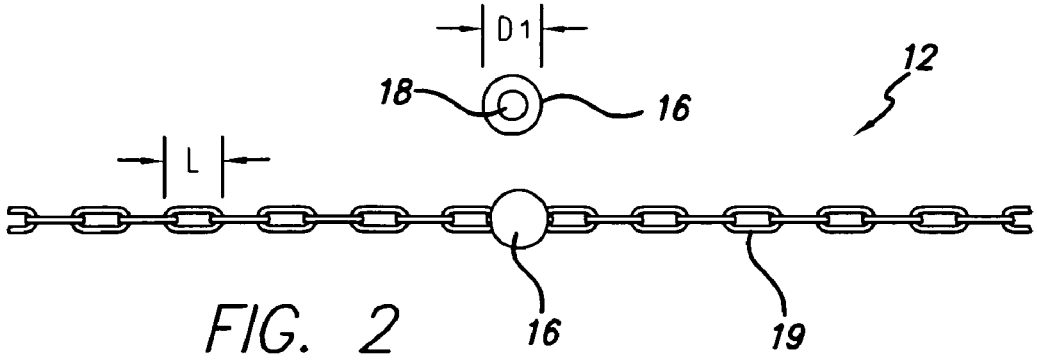
FIG. 2 is an elevational view of a portion of the chain and a bead of the rosary of the embodiment of FIG. 1.
Figure 3:
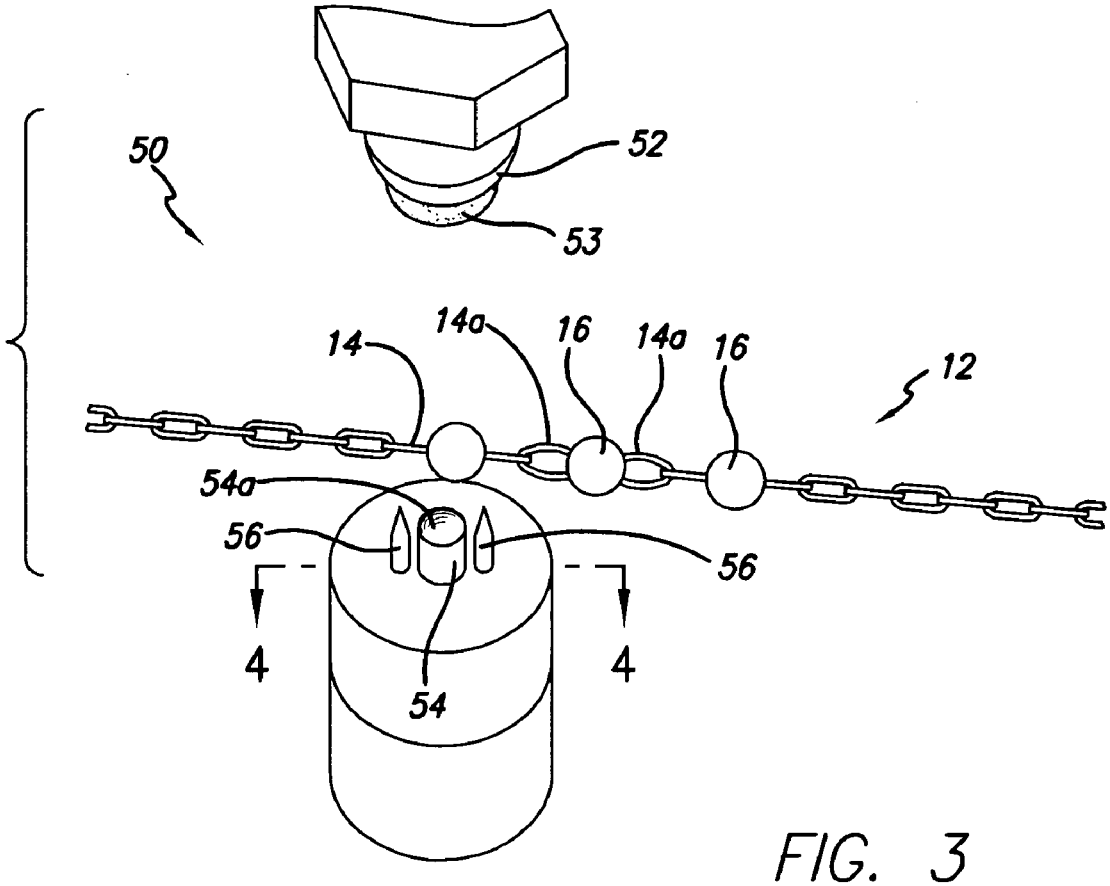
FIG. 3 is a perspective view of a press used in assembly of the rosary of FIG. 1.

In a preferred embodiment the beads 16 are made of a metal. However, the beads 16 can be made of other materials, such as mother of pearl, olive wood or the like. As shown in FIG. 2, in a preferred embodiment the diameter D1 of each bead 16 is approximately the same dimension as the length L of each link 14. Alternatively, the diameter of each bead 16 can be slightly smaller than the length L of each link 14 to allow the bead 16 to move slightly on the link 14, when the rosary 10 is assembled. In another embodiment the diameter of each bead 16 can be approximately the same length of two or more links 14. Each of the beads 16 include an opening 18 defined through the center thereof. The opening 18 is sized to receive the chain 12.

To begin the process of assembling the rosary 10 a bead 16 is placed on the chain 12 by inserting the chain 12 through the opening 18. The bead 16 is then placed in an assembly position as is shown in FIG. 2 whereby approximately an entire link 14 is positioned within opening 18 and the bead 16 is approximately centered between the two links 14 on either side of the link 14 positioned in the opening 18.

Figure 4:
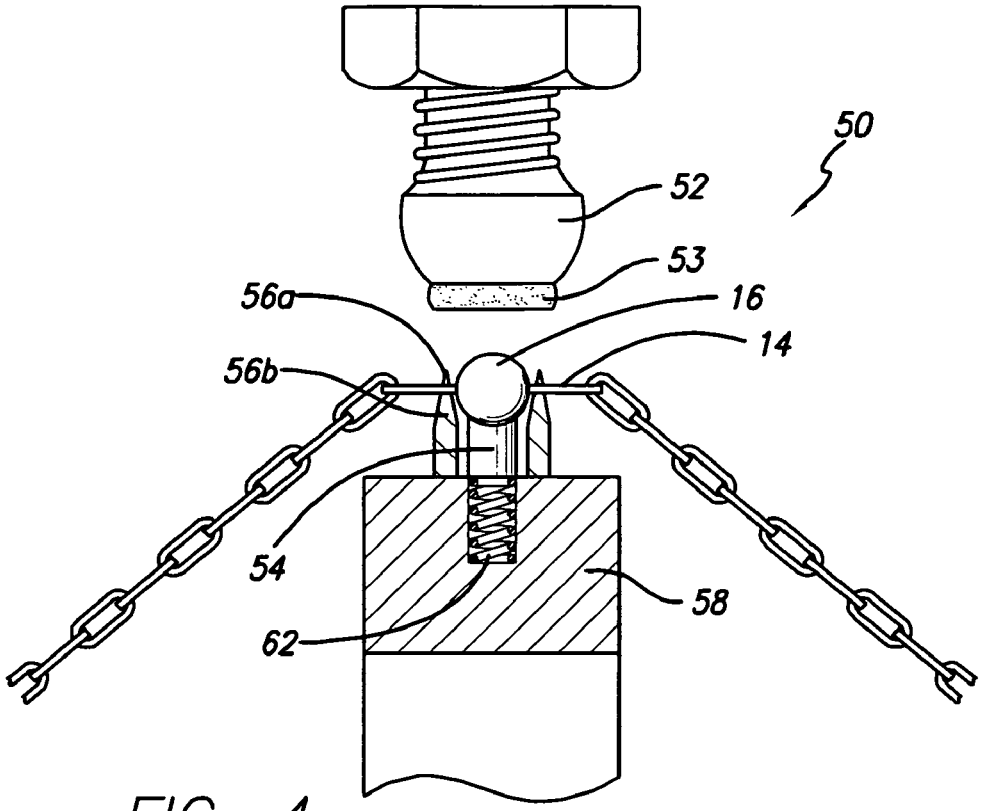
FIG. 4 is a side elevational view of the press of FIG. 3 before actuation with a portion in section (taken along line 4-4 of FIG. 3).

As shown in FIGS. 3-6, a press 50 is used in the assembly of the rosary 10. FIG. 4 shows the press 50 at rest before being actuated. The press 50 generally includes a hammer 52, a support member 54 and two pins 56. In other embodiments the press can include more or less than two pins 56. The press 50 also includes a main body. Presses in general are well known in the art. Accordingly, the main body of the press will not be described herein. However, it will be understood that the support member 54 and the pins 56 extend upwardly from a portion of the main body.

Initially, the bead 16 in the assembly position as described above is placed on a concave upper surface 54*a* of the support member 54. The concave shape of the upper surface 54*a* automatically centers the bead 16 below the hammer 52. The pins 56, which are disposed on opposite sides of the support member 54, extend through the links 14 on the opposite sides of the bead 16. The pins 56 are shaped as shown in FIG. 4 and have a point portion 56*a* and a bottom portion 56*b* with a diameter that is bigger than the point portion.

As shown in FIG. 4, the hammer 52 includes a head 53 thereon. In a preferred embodiment the head 53 is made of an elastomeric material, such as a rubber.

Figure 5:
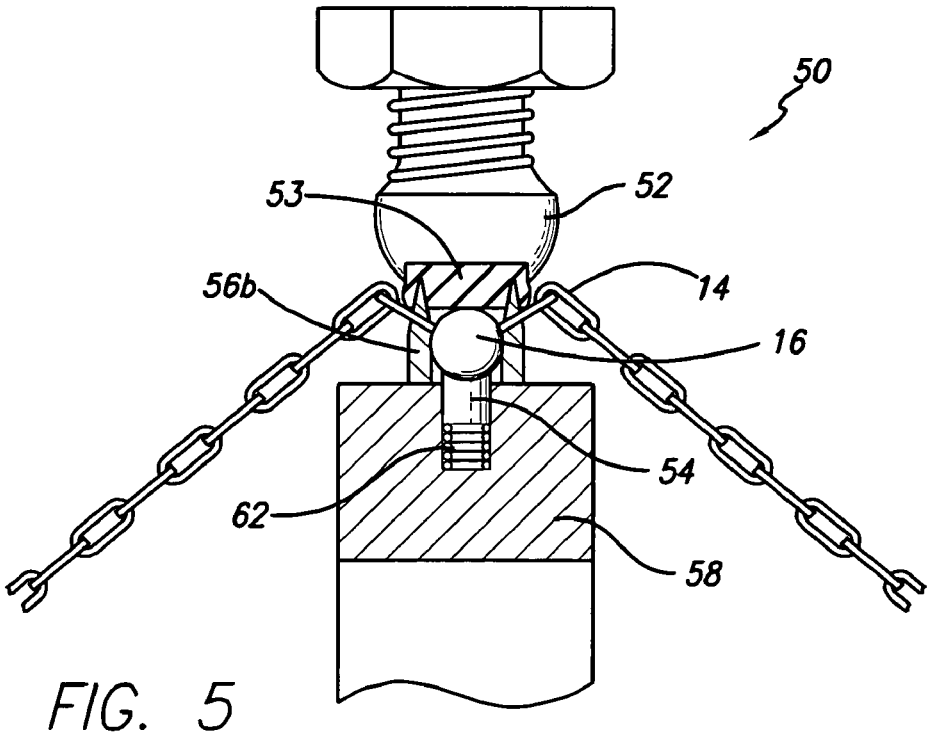
FIG. 5 is a side elevational view of the press of FIG. 3 after actuation with a portion in section.
Figure 6:
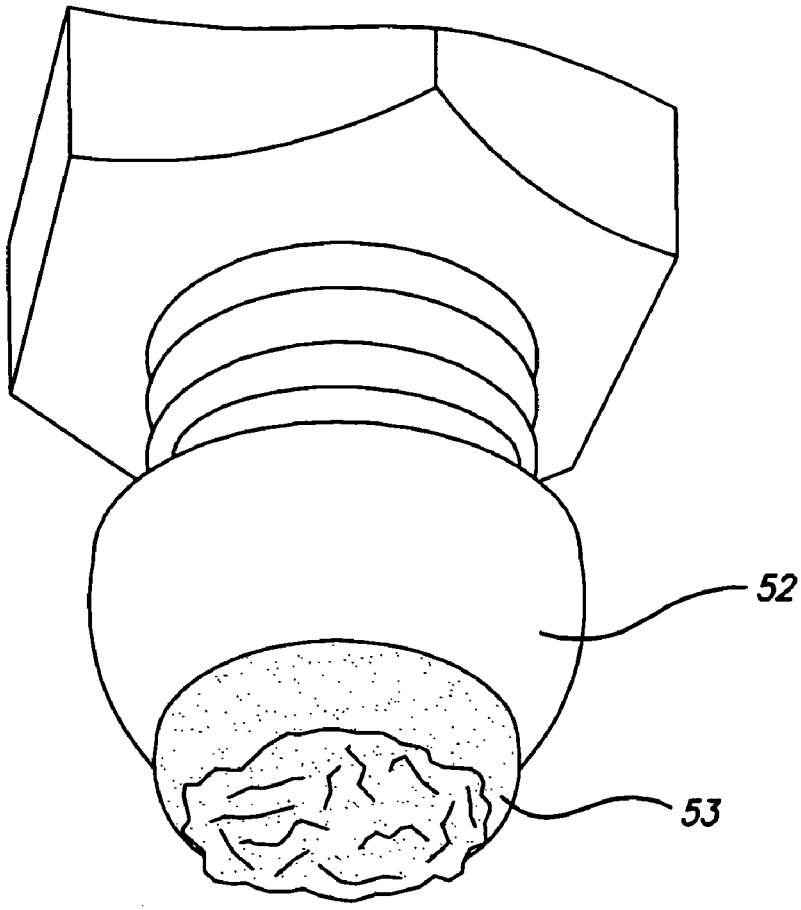
FIG. 6 is a perspective view of the hammer of the press of FIG. 3.

FIG. 5 shows the press 50 in an actuated position. In a preferred embodiment the press 50 is pneumatically actuated. However, the press 50 can also by hydraulically or otherwise operated. The method of actuation of the press is not a limitation on the present invention. After the bead 16 has been placed on the support member 54, the press 50 is actuated, and the hammer 52 is lowered. As shown in FIG. 6, the head 53 has a bottom surface 53*a* that contacts the bead 16 and, in operation, is pierced by the pins 56. Because the pins 56 are made of metal, when the press is actuated, the pins 56 pierce the head 53 (as is best shown in FIG. 5). FIG. 6 shows the head 53 after it has been used a number of times.

The support member 54, which rests on a base 58 is biased upwardly by a spring 62 or the like. The pressure of the hammer 52 against bead 16 causes the support member 54 to move downwardly (thereby depressing spring 62).

With the bead 16 and support member 54 pressed downwardly the pins 56 pierce the head 53. Because the pins 56 pierce the head 53, a portion of the head 53 comes into contact with the links 14 positioned on the pins 56. The pressure of the hammer 52 (and its head 53) against the pins 56 causes the links 14 to press against the bottom portion 56*b* of the pins 56. As a result the metal of the links 14 deform thereby causing the links 14 to widen (as can be seen by the links 14*a* around the middle bead 16 shown in FIG. 3). This locks the bead 16 therebetween in position.

Figure 7:
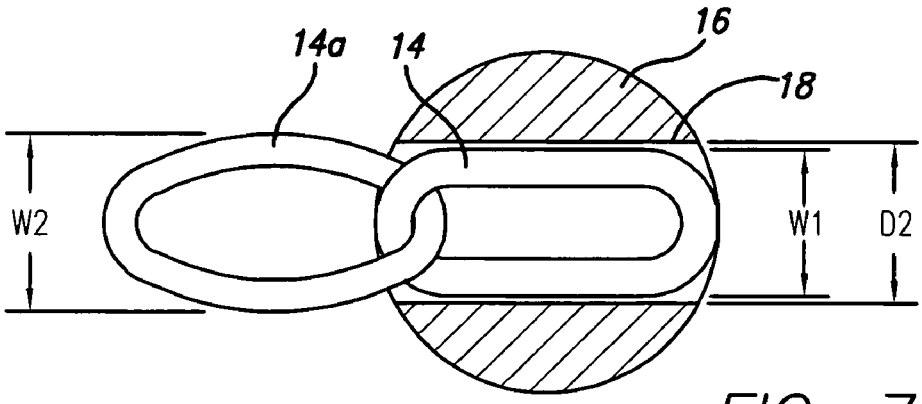
FIG. 7 is a side elevational view of a bead in section and two links according to an embodiment of the present invention.

FIG. 7 shows the dimensions of the bead 16, the opening 18, a non-widened link 14 and a widened link 14*a*. As shown in FIG. 7, the opening 18 has a diameter D2, the non-widened link 14 has a width W1 and the widened link 14*a* has a width W2. The dimension of D2 is greater than the dimension of W1 and less than the dimension of W2. This is what locks bead 16 in place.

After actuation of the press 50 and widening of the desired links 14*a*, the hammer 52 is then raised and the bead 16 is then taken off of the support member 54 and the links 14 are taken off of the pins 56. Another bead 16 and corresponding links 14 are then placed into position and the process is repeated. This process is repeated until all beads 16 are pressed into position as desired. As will be appreciated by those skilled in the art this process can be used to make the loop 26 and the leg 28 separately. The loop 26 and leg 28 can then be attached to the center 22 using jump rings 20 or the like. Lastly, the cross 18 is affixed to the leg using a jump ring 20 or the like.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A method for making an item of jewelry, the method comprising the steps of:

a) providing a chain comprising a plurality of links each having a central opening;

b) providing at least one bead having an opening defined therethrough;

c) providing a press having a support member, a hammer, and at least one pin;

d) positioning the bead on the chain;

e) resting the bead on the support member;

f) positioning a first link on the at least one pin such that the pin extends through the central opening; and g) actuating the press, whereby the first link is widened by the at least one pin.

2. The method of claim 1, wherein the press includes at least two pins positioned on opposite sides of the support member, and wherein the method comprises the additional steps of positioning a second link on the second pin and widening the second link.

3. The method of claim 1 wherein the item of jewelry is a rosary.

4. The method of claim 1 wherein the hammer includes a head thereon.

5. The method of claim 4 wherein the hammer is positioned above the support member.

6. The method of claim 4 wherein the head is made of an elastomeric material.

7. The method of claim 4 wherein when the press is actuated the at least one pin pierces the hammer.

8. The method of claim 6 wherein the support member is biased upwardly by a spring.

9. The method of claim 1 wherein the support member has a concave upper surface.

10. The method of claim 1 wherein when the press is actuated the at least one pin pierces the hammer.

11. The method of claim 1 wherein when the first link is positioned on the at least one pin, the pin extends through an opening in the first link.

12. A method of making an item of jewelry, the method comprising the steps of:

a) providing a chain comprising at least first, second and third links each having a first width;

b) providing at least one bead having an opening defined therethrough, wherein the diameter of the opening has a greater dimension than the first width of the first, second and third links;

c) positioning the bead on the chain by inserting the chain through the opening in the bead such that at least a portion of the second bead is positioned within the opening and the first and third links are positioned on opposite sides of the bead; and d) widening the first and third links to a second width, wherein the second width has a greater dimension than the diameter of the opening, wherein the widening step is performed by a press having at least one pin, wherein the at least one pin extends through the first link, and wherein the first link is widened by the pin when the press is actuated.

13. The method of claim 12 wherein the item of jewelry is a rosary.

* * * * *